United States Patent [19]

Marer

[11] Patent Number: 4,665,826

[45] Date of Patent: May 19, 1987

[54] HYBRID EXPLOSIVE UNIT

[75] Inventor: Joseph C. Marer, Rojales, Spain

[73] Assignee: Brind Anstalt Fuer Industrie Patente, Liechtenstein

[21] Appl. No.: 747,049

[22] PCT Filed: Oct. 3, 1984

[86] PCT No.: PCT/EP84/00313

§ 371 Date: Jul. 15, 1985

§ 102(e) Date: Jul. 15, 1985

[87] PCT Pub. No.: WO85/01572

PCT Pub. Date: Apr. 11, 1985

[30] Foreign Application Priority Data

Oct. 4, 1983 [CH] Switzerland ..... 5387/83

[51] Int. Cl.[4] ..... F42B 23/04; F42B 13/10

[52] U.S. Cl. ..... 102/401; 102/476

[58] Field of Search ..... 102/401, 476

[56] References Cited

U.S. PATENT DOCUMENTS

| | | | |
|---|---|---|---|
| 2,809,585 | 10/1957 | Moses | 102/476 |
| 3,478,685 | 11/1969 | Thomanek | 102/476 |
| 3,661,086 | 5/1972 | Thomanek et al. | 102/476 |
| 4,213,391 | 7/1980 | Drimmer | 102/401 |
| 4,425,850 | 1/1984 | Grössler | 102/307 |

FOREIGN PATENT DOCUMENTS

| | | | |
|---|---|---|---|
| 1901472 | 4/1978 | Fed. Rep. of Germany . | |
| 3019948 | 12/1981 | Fed. Rep. of Germany | 102/476 |
| 7902639 | 4/1984 | Sweden . | |
| 475543 | 8/1969 | Switzerland . | |
| 941430 | 11/1963 | United Kingdom | 102/476 |
| 1142915 | 2/1969 | United Kingdom | 102/476 |
| 2017273 | 10/1979 | United Kingdom . | |
| 2039008 | 7/1980 | United Kingdom | 102/476 |

*Primary Examiner*—Charles T. Jordan

*Attorney, Agent, or Firm*—Steele, Gould & Fried

[57] ABSTRACT

A hybrid explosive unit which is intended for artillery shells or anti-tank mines has a casing, an explosive charge in the casing defining an upwardly-facing hollow, a dished element lining the hollow, a metal cylinder embedded in the charge and extending through a center of the dished element, a sheath of inert material surrounding the cylinder, the cylinder and sheath together forming a first projectile of high penetrating power, and, a plate of inert material embedded in the charge across the lower ends of the cylinder and of the sheath, the plate being adapted, upon firing of the unit, to act as an attenuator and diffractor of the detonation wave, and the plate and dished element together forming a second projectile of high penetrating power which travels behind the first projectile when the unit is fired.

10 Claims, 3 Drawing Figures

HYBRID EXPLOSIVE UNIT

The present invention relates to a hybrid explosive unit, i.e. comprising a detonating explosive and inert material.

Known explosive units used in ventral action anti-tank mines require, in order to function satisfactorily, an auxiliary charge which, prior to detonation of the main charge, displaces the earth covering the embedded mine. In addition, the constituent parts of the mine in the blast zone of the hollow charge disrupt the formation of the blast and cancel out the penetrating effect. In actual practice, providing an auxiliary charge presents numerous problems, amongst others the setting of the delay time for the detonation of the main charge with respect to the auxiliary charge and the force of the auxiliary charge. Other problems are of an external nature and are caused by different types of terrain in which mines may be embedded, ranging from the extreme mobility of sandy terrain to the extreme hardness of frozen terrain.

In British Specification No. 2,039,008A there is disclosed an explosive unit in particular intended for use in anti-tank projectiles, comprising at least two hollow tandem charges of unequal power operating in cascade, one charge being fired first and constituting the exciter charge disposed behind the main charge, a single priming device in the form of a frusto-conical annular body for firing both charges. The blast of the exciter charge is adapted to pass through an axial opening and thus penetrate into the main charge. The system is fired by means of a single priming unit excited by a detonator. A screen disposed between the priming unit and the exciter charge has the effect that the detonation wave produced by the exciter charge is transmitted to the main charge by means of a pyrotechnical relay which functions either as an "accelerator" or as a "retarder" and which is protected by the screen.

Swiss Specification No. 475,543 relates to a hollow charge for anti-tank land mines. The explosive charge is housed in a casing which is closed by a conical insert which displays an angle of substantially 90° and which is disposed over the hollow charge, the apex of the conical insert being cut off and replaced by a cone of inert material.

In German Specification No. 19 01 472 C there is described an explosive head for combating tanks, comprising two hollow charges (primary and secondary) which are activated one after the other. The casing containing the hollow charge is closed at its lower extremity by a disc held in position by a retaining ring. An element is located in an axial hole formed in the disc and a point in the middle of a transmission plate extends into the said element. The rear surface of the primary charge defines a concavity adapted to receive a two part deflector constructed of inert material.

It is an object of the present invention to provide a hybrid explosive unit, in particular for anti-tank mines having a ventral action, able to penetrate the armour plating of the underside of tanks, even when the mines are embedded and covered by a layer of earth 10 to 20 cms. thick. The projectile that issues from the explosive unit provided by the present invention, is actuated by the interaction of detonation waves with appropriate inert materials. It is capable of maintaining its penetrating capacity consistently over a distance of several meters from the point of detonation of the explosive charge, even if it is necessary for the projectile to traverse layers of earth several decimeters in thickness when the unit is exploded.

According to the present invention therefore, there is provided a hybrid explosive unit comprising a casing, an explosive charge in the casing defining, at the upper end thereof, an upwardly facing hollow, a shaped element lining said hollow, a metal cylinder embedded in said charge and extending through the middle of said shaped element, a sheath of inert material surrounding said cylinder, said cylinder and said sheath being adapted together to form a first projectile of high penetrating power, and a member of inert material embedded in said charge across the lower end of said cylinder and of said sheath and adapted, upon the unit being fired, to act as an attenuator and diffractor of the resulting direct detonation wave, said member and said shaped element being adapted together to form a second projectile of high penetrating power which travels behind the first upon the unit being fired.

The expressions "upper" and "lower" refer to the directions when the mine is embedded in use.

Two embodiments of a hybrid explosive unit according to the present invention, will now be described with reference to the accompanying drawings in which.

Figure 1:
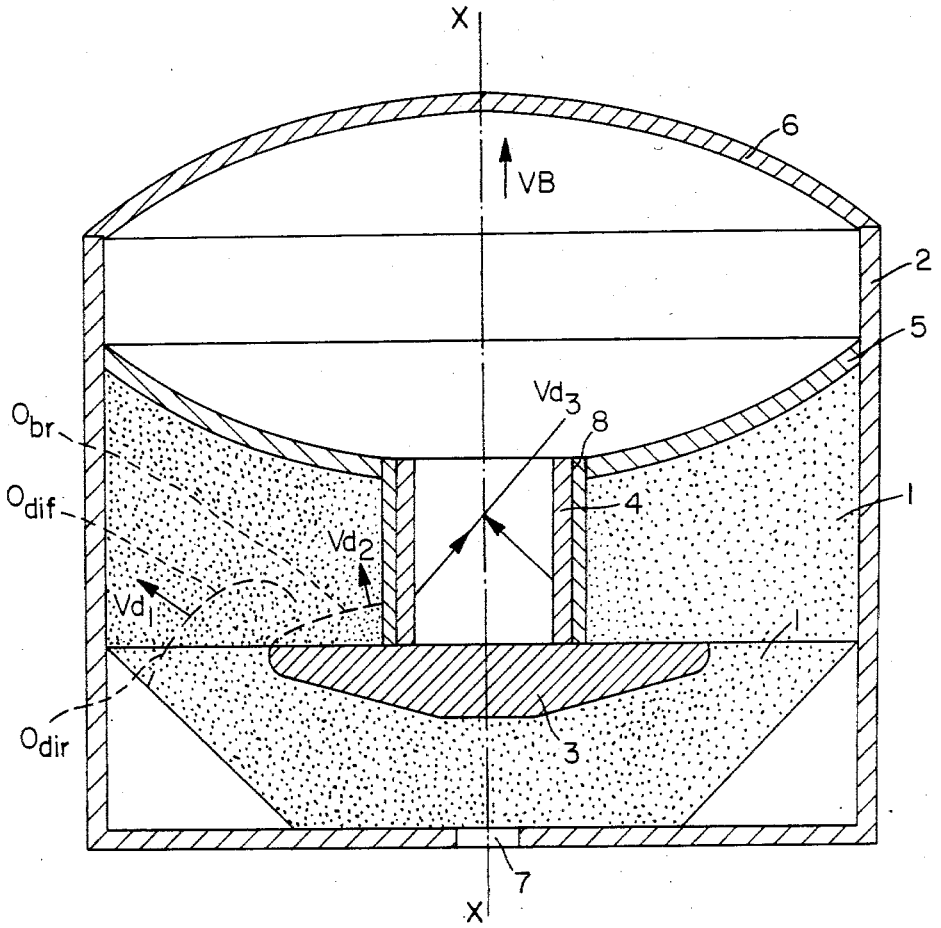
FIG. 1 is an axial cross-section of the first embodiment.
Figure 2:
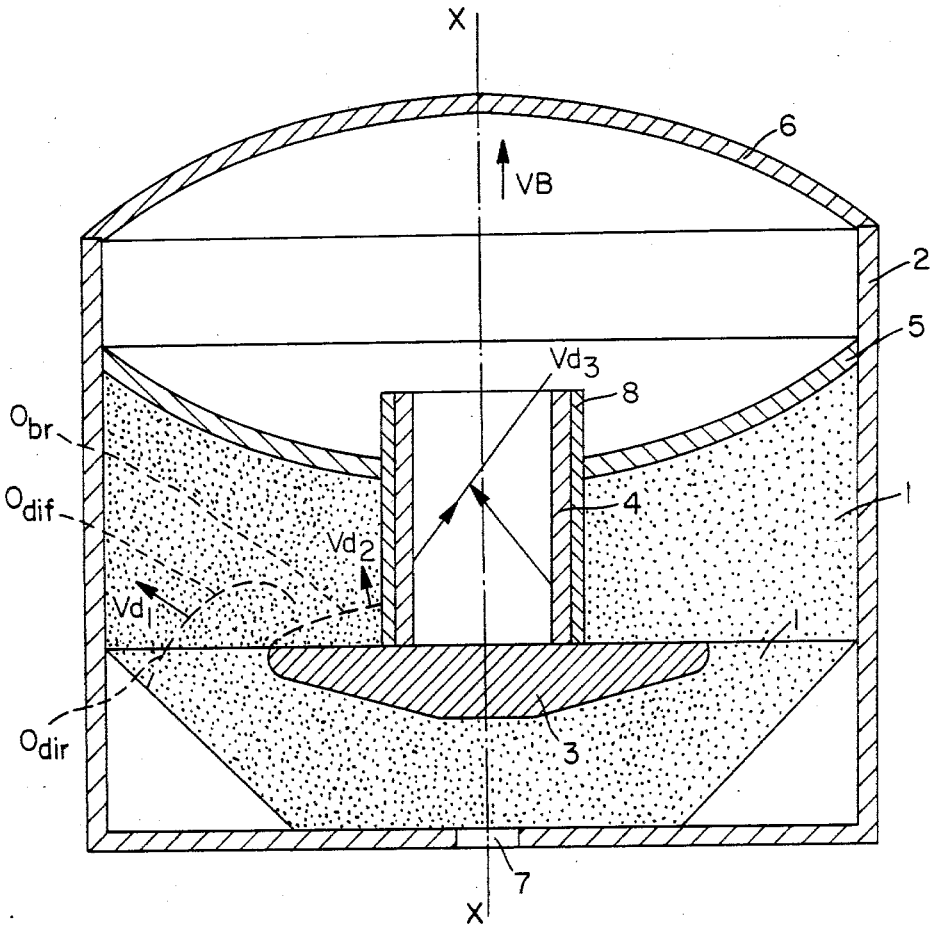
FIG. 2 is an axial cross-section of the second embodiment.

The units shown in FIGS. 1 and 2 have each a hollow explosive charge 1 (e.g. trinitrotoluene (TNT) or cyclonite (T4), shown in dotted form, a casing 2 having an open upper end, a plate 3 of inert material, for example plastic, ceramic or metal, a tubular metal cylinder 4 embedded in the charge 1 and surrounded by a sheath of inert material 8, e.g. resting on the plate 3, a dished metal element 5 lining the hollow in the charge and a cover 6, preferably of synthetic material, closing off the top end of the casing. The metal cylinder 4 may be of such a length, as with the embodiment shown in FIG. 1, that its upper extremity lies flush with the dished element 5 or, as with the embodiment shown in FIG. 2, extends above the dished element 5 depending on the desired length of the blast. All parts in the illustrated units, when viewed from above, have a circular cross-section.

The function of the plate 3 is two-fold: firstly it functions as an attenuator of the resulting shock waves and secondly as a diffraction lens.

Considering the first function of the plate 3. The latter is traversed by a shock wave generated by interaction with a direct detonation wave $O_{dir}$ itself generated at 7 (firing point) and propagated with a velocity $Vd_1$ dependent on the explosive material employed. As it passes through the plate 3, the shock wave is attenuated and is capable of causing an explosion under the plate 3 which is of greater diameter than the metal cylinder 4, thereby generating a detonation, low power, wave $O_{br}$, which is propagated in the explosive material of the hollow charge 1, in the immediate vicinity of the metal cylinder 4, at a velocity $Vd_2$, less than $Vd_1$. The metal cylinder 4 has the tendency, under the influence of the detonation wave of velocity $Vd_2$, of being compressed and of creating a direct high velocity blast along the line of the axis X—X.

In order to achieve optimal penetration into the object to be destroyed, the blast must have both stable dimensions and stable velocity. To achieve the best possible stability, it is essential that the velocity of propagation of the detonation wave in the metal cylinder 4 be somewhat less than or at most equal to the speed of sound in the material composing cylinder 4. It is for this reason that the metal cylinder 4 is surrounded by a sheath of inert material 8.

Figure 3:
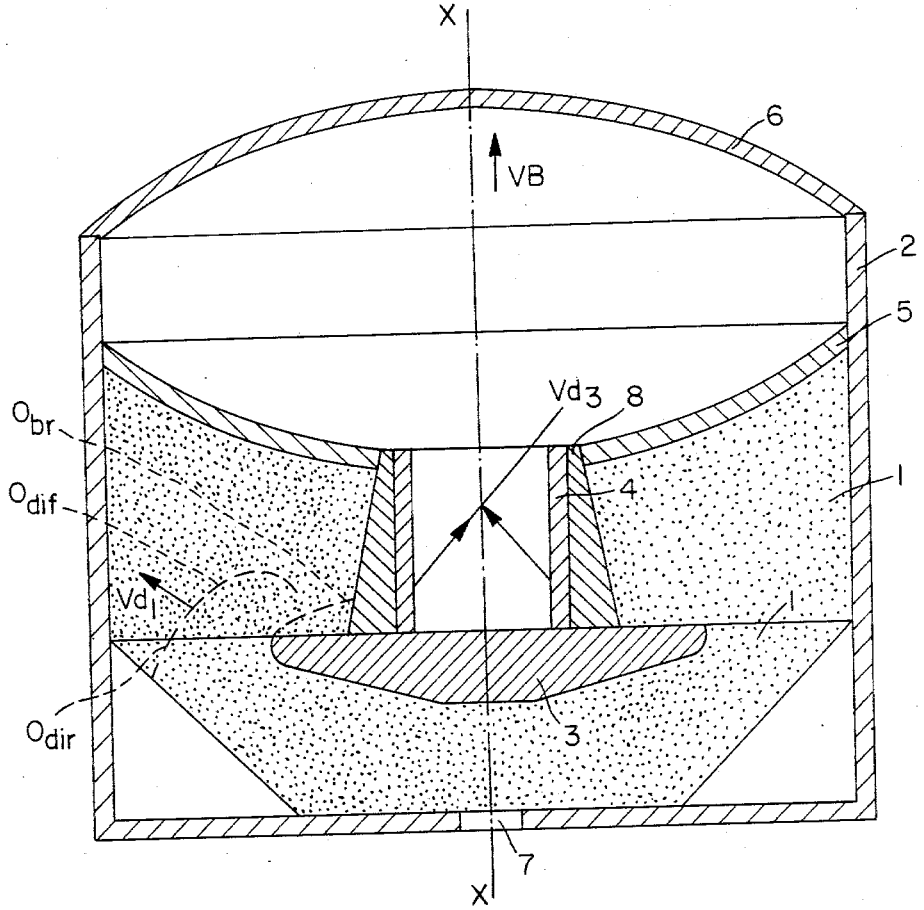
FIG. 3 is an axial cross-section of the third embodiment.

The drop in the velocity $Vd_2$ in the metal cylinder 4 is naturally dependent on the nature of the material used for the sheath 8 and its thickness. This sheath may be cylindrical as shown in FIGS. 1 and 2 or it may be frusto-conical in form with its narrow end adjacent to cover 6, as shown in FIG. 3.

By reducing the velocity $Vd_2$ to a value $Vd_3$, less than the critical velocity intrinsic to the material used for the metal cylinder 4, suitable conditions are created for the generation of a stable blast, that is to say a blast that does not lengthen or disperse during propagation. The length of the blast is practically equal to the height of the metal cylinder 4, while its velocity VB, directed along the axis X—X, is substantially equal to twice $Vd_3$, $Vd_3$ being equal to the velocity of propagation of the explosion wave in the metal cylinder 4.

The part of the metal cylinder 4 which is flush with the upper face of the dished metal element 5 or which extends above the latter (FIG. 2), behaves, in the formation of the first projectile, in the same way as the portion immersed in the explosive. This part, which is subjected to the stresses imposed by the dished element 5 and projected under the impulsive force of the detonating mass, continues to feed the mass of the projectile already in motion.

The second function of the plate 3 is that of acting as a diffraction lens. the direct detonation wave $O_{dir}$, surrounding the inert plate 3, imparts to the diffraction wave $O_{dif}$ an appropriate shape before acting with the dished metal element 5, to constitute a second projectile which travels behind the first projectile formed by the metal cylinder 4 surrounded by the sheath of inert material 8.

With this arrangement, there is created, already within the explosive unit, a stable high velocity projectile, which does not lengthen or disperse over a distance of several meters and is not affected by disturbances caused by possible thicknesses of the terrain covering the explosive unit or other materials covering the hollow explosive charge 1.

The hybrid explosive unit provided by the present invention is also suited for use in artillery shells, inter alia.

I claim:

1. A hybrid explosive unit comprising a casing, an explosive charge in the casing defining, at an upper end thereof, an upwardly facing hollow, a dished element lining said hollow, a metal cylinder embedded in said charge and extending through a center of said dished element, a sheath of inert material surrounding said cylinder, the sheath being frusto-conical and having a narrower end directed upwardly, said cylinder and said sheath being adapted together to form a first projectile of high penetrating power, and a member of inert material embedded in said charge across a lower end of said cylinder and of said sheath and adapted, upon the unit being fired, to act as an attenuator and diffractor of a resulting direct detonation wave, said member and said dished element being adapted together to form a second projectile of high penetrating power which travels behind the first projectile upon the unit being fired.

2. A hybrid explosive unit as claimed in claim 1, wherein the lower end of said cylinder bears against said member of inert material and the upper end of said cylinder is flush with an upwardly facing surface of said dished element.

3. A hybrid explosive unit as claimed in claim 1, wherein the lower end of said cylinder bears on said member of inert material and the upper end of said cylinder protrudes beyond an upwardly facing surface of said dished element.

4. A hybrid explosive unit as claimed in claim 1, wherein said sheath is cylindrical.

5. A hybrid explosive unit as claimed in claim 1, wherein the casing is mounted in an anti-tank mine.

6. A hybrid explosive unit, comprising:

a casing and an explosive charge in the casing defining an upwardly facing hollow at an upper end of the charge;

a dished element lining the hollow;

a hollow metal cylinder embedded in said charge and extending through a center of the dished element;

a sheath of inert material completely surrounding a whole outer circumference of the metal cylinder to thereby form a continuous barrier between the cylinder and the explosive charge and between the cylinder and the dished element, the barrier being effective to reduce a propogation velocity of a detonation wave within metal forming the cylinder to no more than a speed of sound in that metal; and, a shaped body of inert material embedded in the explosive charge and disposed across a lower end of the cylinder, a detonation point for the hybrid explosive unit being located below the shaped body, the shaped body being of greater diameter than the cylinder and being effective to attentuate and diffract the detonation wave impinging directly thereon from the detonation point, whereby the cylinder and sheath are ejected as a first projectile of high penetrating power, and the dished element and shaped body are ejected as a second projectile of high penetrating power which travels behind the first projectile upon firing of the unit.

7. A hybrid explosive unit as claimed in claim 6, wherein the lower end of the cylinder bears on the shaped body and the upper end of the cylinder is flush with an upwardly facing surface of the dished element.

8. A hybrid explosive unit as claimed in claim 6, wherein the lower end of the cylinder bears on the shaped body and the upper end of the cylinder protrudes beyond an upwardly facing surface of the dished element.

9. A hybrid explosive unit as claimed in claim 6, wherein the sheath is cylindrical.

10. A hybrid explosive unit as claimed in claim 6, wherein the sheath is frusto-conical and has a narrower end directed upwardly.

* * * * *